US005944125A

United States Patent [19]

Byrd

[11] Patent Number: 5,944,125

[45] Date of Patent: Aug. 31, 1999

[54] ROCK BIT WITH IMPROVED THRUST FACE

[75] Inventor: Chris S. Byrd, Dallas, Tex.

[73] Assignee: Varel International, Inc., Dallas, Tex.

[21] Appl. No.: 08/878,622

[22] Filed: Jun. 19, 1997

[51] Int. Cl.[6] ..... E21B 10/22

[52] U.S. Cl. ..... 175/371; 384/93

[58] Field of Search ..... 384/93, 92, 95; 175/229, 371, 372

[56] References Cited

U.S. PATENT DOCUMENTS

| | | | |
|---|---|---|---|
| 1,708,288 | 4/1929 | Wadsworth . | |
| 1,762,504 | 6/1930 | Bull . | |
| 1,764,854 | 6/1930 | Reed . | |
| 1,816,203 | 7/1931 | Behnke . | |
| 1,989,261 | 1/1935 | Behnke | 255/71 |
| 1,992,992 | 3/1935 | Collins | 255/71 |
| 2,065,742 | 12/1936 | Reed | 255/71 |
| 2,076,845 | 4/1937 | Howard et al. | 255/71 |
| 2,086,397 | 7/1937 | Thaheld | 255/71 |
| 2,124,521 | 7/1938 | Williams et al. | 255/71 |
| 2,165,584 | 7/1939 | Smith et al. | 255/71 |
| 2,192,697 | 3/1940 | Scott | 255/71 |
| 2,526,838 | 10/1950 | Akeyson | 255/71 |
| 2,644,671 | 7/1953 | Ingram | 255/71 |
| 2,648,526 | 8/1953 | Lanchester | 255/71 |
| 2,654,577 | 10/1953 | Green | 255/304 |
| 2,728,559 | 12/1955 | Boice et al. | 255/334 |
| 2,807,444 | 9/1957 | Reifschneider | 255/313 |
| 2,814,465 | 11/1957 | Green | 255/341 |
| 2,831,661 | 4/1958 | Brown | 255/313 |
| 3,086,601 | 4/1963 | Galle et al. | 175/372 |
| 3,239,431 | 3/1966 | Knapp | 175/331 |
| 3,420,324 | 1/1969 | Vesper | 175/339 |
| 3,424,258 | 1/1969 | Nakayama | 175/333 |
| 3,656,764 | 4/1972 | Robinson | 277/92 |
| 3,721,307 | 3/1973 | Mayo | 175/372 |
| 3,746,405 | 7/1973 | Welton | 308/8.2 |
| 3,784,264 | 1/1974 | Jackson, Jr. | 308/8.2 |
| 3,845,994 | 11/1974 | Trey | 308/8.2 |
| 3,850,256 | 11/1974 | McQueen | 175/228 |
| 3,907,191 | 9/1975 | Lichte | 228/182 |
| 4,043,411 | 8/1977 | Liechte | 175/369 |
| 4,098,150 | 7/1978 | Penny et al. | 76/108 A |
| 4,109,974 | 8/1978 | Svanstrom et al. | 384/93 |
| 4,127,043 | 11/1978 | Evans | 76/108 A |
| 4,187,743 | 2/1980 | Thomas | 76/108 A |
| 4,256,194 | 3/1981 | Varel | 175/375 |
| 4,333,364 | 6/1982 | Varel | 76/108 A |
| 4,491,428 | 1/1985 | Burr et al. | 384/93 |
| 4,600,064 | 7/1986 | Scales et al. | 175/368 |
| 4,763,736 | 8/1988 | Varel | 175/341 |
| 5,307,887 | 5/1994 | Welsh | 384/93 X |
| 5,586,611 | 12/1996 | Dorosz | 384/95 X |
| 5,725,313 | 3/1998 | Singh et al. | 384/93 |

FOREIGN PATENT DOCUMENTS

| | | |
|---|---|---|
| 1361289 | 3/1986 | U.S.S.R. . |
| 175369 | 11/1930 | United Kingdom . |

*Primary Examiner*—William Neuder
*Attorney, Agent, or Firm*—Baker & Botts, L.L.P.

[57] ABSTRACT

A rotary cone drill bit includes a drill bit body having two or more support spindles extending inward and downward toward a vertical axis of the drill bit body. Each support spindle of the drill bit includes a base pin and further includes a pilot pin extending from the base pin along a longitudinal axis of the support spindle. A conical-shaped thrust face forms the transition from the base pin to the pilot pin. A cutting cone is rotatably mounted on each support spindle and includes a conical internal surface to run in contact with the conical thrust face of the support spindle. Rotation of the cutting cone carries lubricant from the non-load side of the spindle to the contact surfaces on the load side of the spindle.

13 Claims, 2 Drawing Sheets

ROCK BIT WITH IMPROVED THRUST FACE

TECHNICAL FIELD

The present invention relates to drill bits, and more particularly to drill bits having a support spindle with a conical thrust face for supporting a rotatable cutting cone.

BACKGROUND OF THE INVENTION

Drill bits utilizing rotary cones for earth boring operations are well known in the art of drilling. The bits generally include a threaded upper portion that attaches to a drill string and a body portion with three downwardly and inwardly facing support spindles. Each support spindle consists of a cylindrical base pin and a smaller, cylindrical pilot pin further projecting along the longitudinal axis of the spindle. A cutting cone is rotatably mounted on each of the support spindles. Each cutting cone includes spaced rows of cutting teeth distributed around the outer surface of the cone.

During operation of an earth boring drill bit, the weight of the drill string places a load on the lower face of the cutting cone. The load generally causes contact between an inner surface of the cutting cone and a surface of the support spindle. The friction resulting from this contact between the rotating cutting cone and the stationary support spindle causes wear on the contacting surfaces that limits the useful life of the drill bit. To combat this problem, many bits use lubricant on the contacting surfaces between the support spindle and the cutting cone to slow the rate of surface wear. Drill bits or prior designs, however, prevent uniform lubrication of the spindle and causes some parts of the spindle to wear out more rapidly than others.

In a drill bit of a prior design, the load generally causes contact between an inner surface of the cutting cone and a surface of the support spindle on the lower, or load, side. The load also causes a corresponding gap between the inner surface of the cutting cone and a surface of the support spindle on the upper, or non-load, side. To maintain lubrication of the spindle, conventional bits rely on a process by which the rotation of the cone carries lubricant from the gap on the non-load side of the spindle to the contacting surfaces on the load side of the spindle.

The exact location of the contact between the spindle and cutting cone surfaces depends on the location of the load applied to the bit. Earth boring bits operate in two basic modes. Most cutting cones are designed so that the load is primarily applied to the outer one or two rows of cutting teeth. Bits with cutting cones of this type operate in a "cocked" mode. Cutting cones that are designed so that the load is applied closer to the centerline of the bit body operate in a "normal" mode. The operative mode is determined by the location of the load applied to the cutting cone when engaging rock at the hole bottom. The location of the load applied to the cone is a function of the cone design. In both the "normal" and "cocked" mode, the rotation of the cutting cone delivers sufficient lubricant to the contacting surfaces of the base pin and pilot pin to provide effective lubrication of those surfaces.

However, conventional drill bits also include a flat thrust face at the transition between the base pin and the pilot pin for supporting axial loads applied to the cutting cone. When the cutting cones of these conventional bits are loaded in the "normal" mode, the axial component of the load causes a radial inner surface of the cutting cone to substantially contact the entire thrust face surface. When the bits operate in a "cocked" mode, there is a gap on the non-load side of the thrust face, although this gap is smaller than the gaps on the lateral surfaces of the spindle. The reduced size or absence of a gap on the non-load side reduces the ability of the rotating cutting cone to carry lubricant to the load side. In either the "normal" or "cocked" mode, therefore, the thrust face does not lubricate as efficiently as do the lateral surfaces of the spindle. The lack of lubrication on the thrust face increases heat generated by friction thereby promoting galling of the spindle and often causing premature failure of the spindle. Consequently, the useful life of the drill bit is limited by the inability to maintain sufficient lubrication of the spindle thrust face. The present invention addresses these friction-related problems by shaping the support spindle to promote lubrication of the thrust face.

SUMMARY OF THE INVENTION

The present invention comprises a rotary cone drill bit with an improved support spindle. The earth boring drill bit of the present invention includes two or more support spindles that project downwardly and inwardly from a drill bit body, each spindle supporting a rotatable cutting cone. Each support spindle includes a cylindrical base pin and a smaller cylindrical pilot pin extending along a longitudinal axis of the base pin. In accordance with the present invention, the support spindle further includes a conical thrust face at the transition between the base pin and the pilot pin. The inner surface of the cutting cone also includes a conical thrust face surface for mating with the spindle thrust face when the cutting cone is mounted on the drill bit.

The conical shape of the thrust face increases clearance between the non-load side of the support spindle and an inner surface of the cutting cone in both a "normal" and a "cocked" mode of operation. In the "normal" mode, the inner surface of the cutting cone does not contact the thrust face on the non-load side of the spindle as in a conventional drill bit with a flat thrust face. Lubrication of the thrust face is improved because the rotation of the cutting cone carries lubricant from the gap on the non-load side to the contacting surfaces on the load side. When the bit is operating in a "cocked" mode, on the other hand, the conical shape of the thrust face produces a larger gap on the non-load side of the spindle than there is on a spindle with a flat thrust face. The larger gap enables the rotating cone to more efficiently deliver lubricant to the contacting thrust face surfaces on the load side of the drill bit. By improving lubrication of the spindle thrust face in both the "cocked " and "normal" modes of operation, a drill bit of the present invention has a longer useful life and generates less heat by friction than conventional drill bits with a flat thrust face.

In accordance with another feature of the present invention, the support spindle includes an annular groove that encircles the thrust face surface. The groove is filled with a hard metal or ceramic insert to reduce the rate of wear on the thrust face.

BRIEF DESCRIPTION OF THE DRAWINGS

A more complete understanding of the present invention may be had by reference to the following Detailed Description when taken in conjunction with the accompanying drawings wherein.

DETAILED DESCRIPTION OF THE INVENTION

Figure 1:
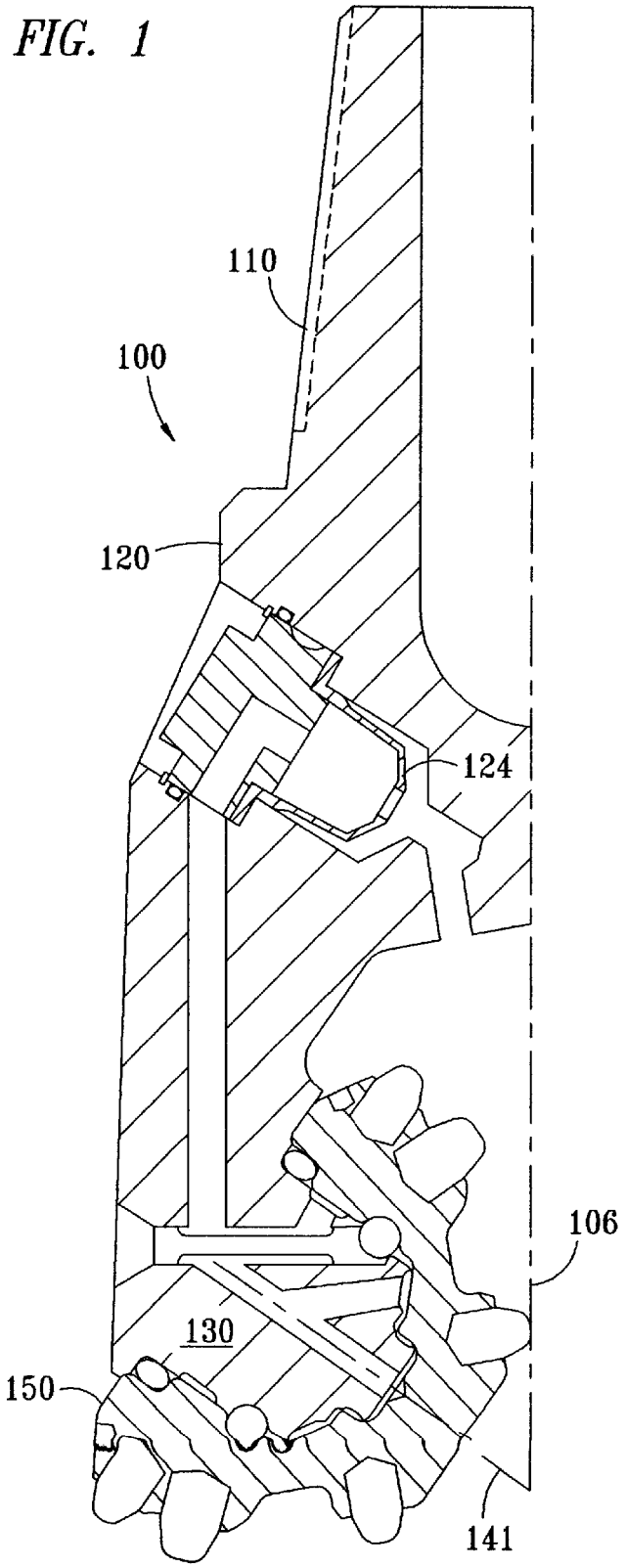
FIG. 1 is a cross section view of a rotary cone drill bit having a support spindle with a conical thrust face in accordance with the present invention.

Reference is now made to the Drawings wherein like reference characters denote like or similar parts throughout the various Figures.

Referring to FIG. 1, there is illustrated a section of an earth boring drill bit 100. The drill bit includes an upper threaded portion 110 for connection to the lowest section of a drill string (not shown). A body 120 of the drill bit 100 extends from the lower part of the threaded portion 110 and contains a lubrication chamber 124 for storing lubricant. The drill bit body 120 has three (only one shown) inwardly and downwardly directed support spindles 130 adapted to rotatably support a cutting cone 150 such that each spindle is oriented to form a longitudinal axis of rotation 141 that passes through a vertical axis 106 of the bit body 120. It should be understood that the axis of rotation 141 in accordance with some bit designs does not pass through the vertical axis 106.

Figure 2:
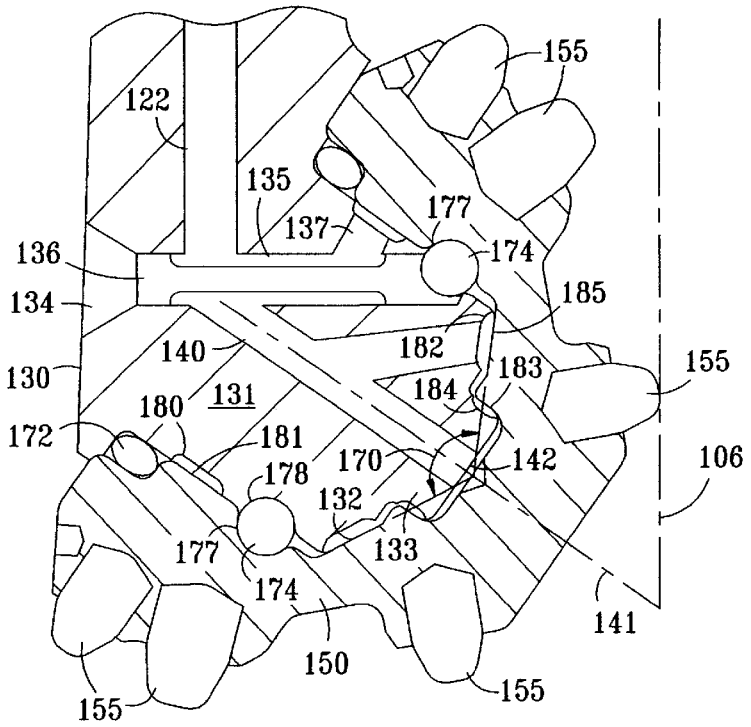
FIG. 2 is a cross section view of a cutting cone having hard metal inserts, and a support spindle, having a conical thrust face in accordance with the present invention.

Referring now to FIG. 2, one support spindle 130 and cutting cone 150 of the present invention are shown in more detail. The cutting cone 150 includes hard metal insert cutting teeth 155 that are distributed in rows across the outer surface of the cutting cone 150. The cutting cone 150 is retained on the support spindle 130 by the use of conventional retainer balls 174 inserted into a ball race. The ball race comprises a ball race groove 177 having a semicircular trough-like configuration encircling the inner surface of the cutting cone 150 and a ball race groove 178 having a corresponding semicircular trough-like configuration encircling the support spindle 130. The retainer balls 174 are inserted into the ball race through a passageway 135 that is also a part of a lubrication conduit in the support spindle 130. The passageway 135 is in communication with the lubrication chamber 124 (shown in FIG. 1) by channel 122. A pin 136 is inserted in the passageway 135 and secured in place by a plug 134 to hold the retainer balls 174 in the ball race.

The support spindle 130 includes three main parts: a base pin 131, a pilot pin 133, and a conical thrust face 132. The cylindrical base pin 131 forms the upper part of the spindle 130 and includes an outer surface that functions as the primary load bearing support and provides radial support for the cutting cone 150. The cylindrical pilot pin 133 projects from the lower end of the base pin 131 along the longitudinal axis 141 of the support spindle 130. The pilot pin 133 is smaller in diameter than the base pin 131 and includes a load bearing outer surface that provides additional radial support and substantially minimizes cocking of the cutting cone 150 during a drilling operation. The conical thrust face 132 is the surface of the spindle 130 between the base pin 131 and the pilot pin 133. The thrust face 132 provides a load bearing surface to axially support the cutting cone 150. Similarly configured inner surfaces of the cutting cone 150 mate with the base pin 131, pilot pin 133, and thrust face 132 of the support spindle 130.

A groove 180 encircles the middle section of the base pin 131 adjacent to the retainer balls 174. Another groove 184 encircles the pilot pin 133, and a substantially ring shaped groove 182 encircles the conical thrust face 132. The grooves are filled in a conventional manner with hard metal or ceramic to form bearing inserts 181, 183, and 185. A spindle bearing is provided in the cutting cone 150 in a position opposite the bearing insert 181 of the base pin 131 and provides a bearing surface that is in rotating contact with the base pin 131.

Referring again to FIG. 1 and FIG. 2, lubrication of the spindle 130 is provided by a system of channels and passageways through the drill bit body 120. Lubricant is supplied through a passageway 122 to one end of the passageway 135. A channel 140 further extends along the spindle axis 141 and carries lubricant to an opening 142 in the end surface of the pilot pin 133 to lubricate the outer surface of the support spindle 130 and the inner surface of the cutting cone 150. The passageway 135 provides for additional lubrication by the flow of lubricant from the lower end of the base pin 131. Finally, a short passageway 137 carries lubricant from the passageway 135 for lubricating the spindle bearing. An O-ring seal 172 restricts lubricant from escaping out of the gap between the spindle 130 and the cutting cone 150.

During a drilling operation, the cutting teeth 155 engage rock at the bottom of a hole, thereby generating a load on the cutting cone 150 and a resultant force on the support spindle 130. The location of the load on the cutting cone 150 primarily depends on the design of the cone. The design of most cutting cones causes most of the load to be applied to the outer two rows of cutting teeth. This load causes the cutting cone 150 to tilt or cock at an angle to the longitudinal axis 141.

The location of the load causes inner surfaces of the cutting cone 150 and outer surfaces of the support spindle 130 to contact on the lower, or load, side of the drill bit 100. Specifically, contact is made at the lower side of the thrust face 132 and base pin 131 and the pilot pin 133. There is a corresponding increase in the gap between non-load surfaces of the support spindle 130 and the cutting cone 150. Specifically, the load causes an increased gap on the non-load side of the thrust face 132, and the base pin 131 and the pilot pin 133. The rotation of the cutting cone 150 on the support spindle 130 carries lubricant from the gaps on the non-load sides of the base pin 131, the pilot pin 133, and the thrust face 132 to the load side on the opposite side of the support spindle, thereby providing lubrication for the load bearing surfaces of the support spindle.

Figure 3:
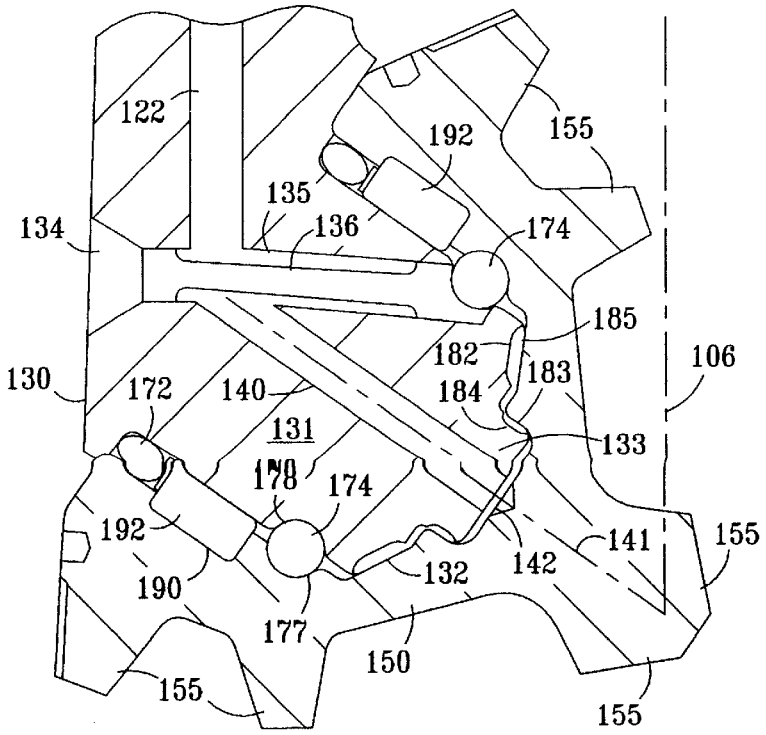
FIG. 3 is a cross section view of a cutting cone having cutting teeth integral with the cone, and a support spindle having a conical thrust face in accordance with the present invention.

Referring to FIG. 3, there is illustrated a drill bit with roller bearings and a conical thrust face in accordance with the present invention wherein the cutting cone 150 includes cutting teeth 155 integral with the cone surface. The inner surfaces of the cutting cone 150 include a bearing channel 190 provided with roller bearings 192 in contact with the support spindle 130 on the load side of the base pin 131. The pilot pin 133 and the thrust face 132 of the embodiment of FIG. 3 are similar to the corresponding parts of the drill bit of FIG. 2. The load also causes a corresponding gap on the non-load side of the base pin 131, the pilot pin 133, and the thrust face 132. Rotation of the cutting cone 150 delivers lubricant from the gap on the non-load side to the load side.

Referring again to FIG. 2, an included angle 170 of the thrust face 132 is illustrated as the interior angle defined by the conical thrust face surface. The included angle 170 of the thrust face 132 varies in accordance with the drill bit design. Drill bits with a smaller included angle have increased clearance between the thrust face 132 and the inner surface of the cutting cone 150 on the non-load side. Increased clearance provides for improved lubrication of the thrust face 132 because more lubricant is available for delivery to the contacting surface of the thrust face. In contrast, drill bits with larger included angles provide less effective thrust face lubrication because there is less clearance on the non-load side. The range of possible values for the included angle 170, however, is limited as a practical matter. If the included angle 170 becomes too small, the conical thrust face projects too far into the interior of the cutting cone 150 and there is no room for a pilot pin 133. Because a pilot pin 133 is necessary to minimize cocking of the cutting cone 150 during drilling, the included angle cannot be smaller than about 90 degrees. On the other hand, as the included angle 170 of the cutting cone 150 becomes too large, the design approaches that of a bit with a flat thrust face and the advantages of the present invention are dissipated. As a practical matter, therefore the included angle 170 of the thrust face 132 is about 150 degrees. In a preferred embodiment, the included angle of the thrust face 132 is 120 degrees.

Although a preferred embodiment of the invention has been illustrated in the accompanying drawings and described in the foregoing Detailed Description, it will be understood that the invention is not limited to the embodiment disclosed, but is capable of numerous rearrangements and modifications of parts and elements without departing from the spirit of the invention.

I claim:

1. A rotary cone drill bit, comprising:

a drill bit body;

a plurality of inwardly directed support spindles, each of said support spindles having a longitudinal axis and further including:

a base pin extending from the bit body along the longitudinal axis;

a pilot pin having a longitudinal axis coincident with the longitudinal axis of the base pin; and a substantially conical load bearing thrust face extending between the base pin and the pilot pin; and a plurality of cutting cones equal in number to the plurality of support spindles, each of said cones mounted to rotate on a respective support spindle and including a first inner surface mating with the base pin, a second inner surface mating with the pilot pin, and a substantially conical inner surface in mating contact with the substantially conical thrust face of said support spindle.

2. The drill bit of claim 1 wherein the cone defined by the thrust face has an included angle in the range of about 90 degrees to about 150 degrees.

3. The drill bit of claim 2 wherein the included angle is about 120 degrees.

4. The drill bit of claim 1 wherein the thrust face includes a hard facing insert.

5. The drill bit of claim 1 wherein each of the support spindles further includes one or more passageways for supplying lubricant to an outer surface of the support spindle.

6. A rotary cone drill bit comprising:

a bit body having a central vertical axis;

three support spindles equidistantly spaced around the central vertical axis, each support spindle having an orientation directed inward toward the central vertical axis and having a longitudinal axis, wherein each support spindle includes:

a base pin extending from the bit body along the longitudinal axis;

a pilot pin having a longitudinal axis coincident with the longitudinal axis of the base pin; and a conical thrust face extending between the base pin and the pilot pin;

three cutting cones, said cutting cones individually rotatably mounted on a respective support spindle, and having a first inner surface mating with the base pin, a second inner surface mating with the pilot pin, and a conical inner surface in mating contact with the conical thrust face of said support spindle.

7. The rotary cone drill bit of claim 6 wherein the cone defined by the thrust face has an included angle in the range of about 90 degrees to about 150 degrees.

8. The drill bit of claim 7 wherein the included angle is about 120 degrees.

9. The drill bit of claim 6 wherein the thrust face includes a hard facing insert.

10. A rotary cone drill bit, comprising:

a drill bit body;

a plurality of inwardly directed support spindles, each of said support spindles having a longitudinal axis and further including:

a base pin extending from the bit body along the longitudinal axis;

a pilot pin having a longitudinal axis coincident with the longitudinal axis of the base pin; and a substantially conical thrust face extending between the base pin and the pilot pin, said conical thrust face having a hard facing insert; and a plurality of cutting cones equal in number to the plurality of support spindles, each of said cones mounted to rotate on a respective support spindle and including a substantially conical inner surface to run in contact with the substantially conical thrust face of said support spindle.

11. The drill bit of claim 10 wherein the cone defined by the thrust face has an included angle in the range of about 90 degrees to about 150 degrees.

12. The drill bit of claim 10 wherein the included angle is about 120 degrees.

13. A rotary cone drill bit comprising:

a bit body having a central vertical axis;

three support spindles equidistantly spaced around the central vertical axis, each support spindle having an orientation directed inward toward the central vertical axis and having a longitudinal axis, wherein each support spindle includes:

a base pin extending from the bit body along the longitudinal axis;

a pilot pin having a longitudinal axis coincident with the longitudinal axis of the base pin; and a conical thrust face extending between the base pin and the pilot pin, said conical thrust face having a hard facing insert; and three cutting cones, said cutting cones individually rotatably mounted on a respective support spindle, and having a conical inner surface to run in contact with the conical thrust face of said support spindle.

* * * * *